United States Patent [19]

Schwoerer et al.

[11] 4,285,396

[45] Aug. 25, 1981

[54] STEAM GENERATOR TUBE SUPPORT SYSTEM

[75] Inventors: Frank Schwoerer, Chevy Chase, Md.; William J. Wachter, Wexford, Pa.

[73] Assignee: Wachter Associates, Inc., Gibsonia, Pa.

[21] Appl. No.: 6,415

[22] Filed: Jan. 25, 1979

[51] Int. Cl.[3] ..... F28D 7/00; F22B 37/24

[52] U.S. Cl. ..... 165/162; 165/69; 165/82; 122/510; 122/511; 138/113; 138/114

[58] Field of Search ..... 122/510, 511, DIG. 13, 122/235 K; 165/69, 82, 162, 172; 285/133, 138; 138/113, 114

[56] References Cited

U.S. PATENT DOCUMENTS

| | | | |
|---|---|---|---|
| 2,297,146 | 9/1942 | Guirl | 138/113 |
| 2,512,116 | 6/1950 | Siebels | 138/113 |
| 2,610,832 | 9/1952 | Holmes et al. | 165/162 |
| 2,707,493 | 5/1955 | Bonvillian et al. | 138/113 |
| 2,914,090 | 11/1959 | Isenberg | 138/113 |
| 3,126,918 | 3/1964 | Eaton | 138/113 |
| 3,137,638 | 6/1964 | Kumpf et al. | 165/172 |
| 3,144,081 | 8/1964 | Skiba | 165/162 |
| 3,277,959 | 10/1966 | Withers | 165/162 |
| 3,420,297 | 1/1969 | Romanos | 122/510 |
| 3,503,440 | 3/1970 | Romanos | 165/162 |
| 3,785,407 | 1/1974 | Waite et al. | 138/114 |
| 3,804,354 | 4/1974 | Weiss | 165/162 |
| 4,056,441 | 11/1977 | Marmonier et al. | 165/162 |
| 4,117,885 | 10/1978 | Nickerson et al. | 122/511 |

*Primary Examiner*—Henry C. Yuen

*Attorney, Agent, or Firm*—Thomas H. Murray; Clifford A. Poff

[57] ABSTRACT

A system for supporting a bundle of tubes against lateral movement in a heat exchanger, such as a nuclear power plant steam generator, wherein spring collar devices positioned at intervals along the tubes permit lateral movement of the tubes but prevent any relative movement between the tube and its associated spring collar device. Any lateral movement is between adjacent spring collar devices. With this arrangement, fretting and corrosion between the outer surfaces of the tubes and their lateral support members are substantially eliminated.

11 Claims, 9 Drawing Figures

Fig. 3
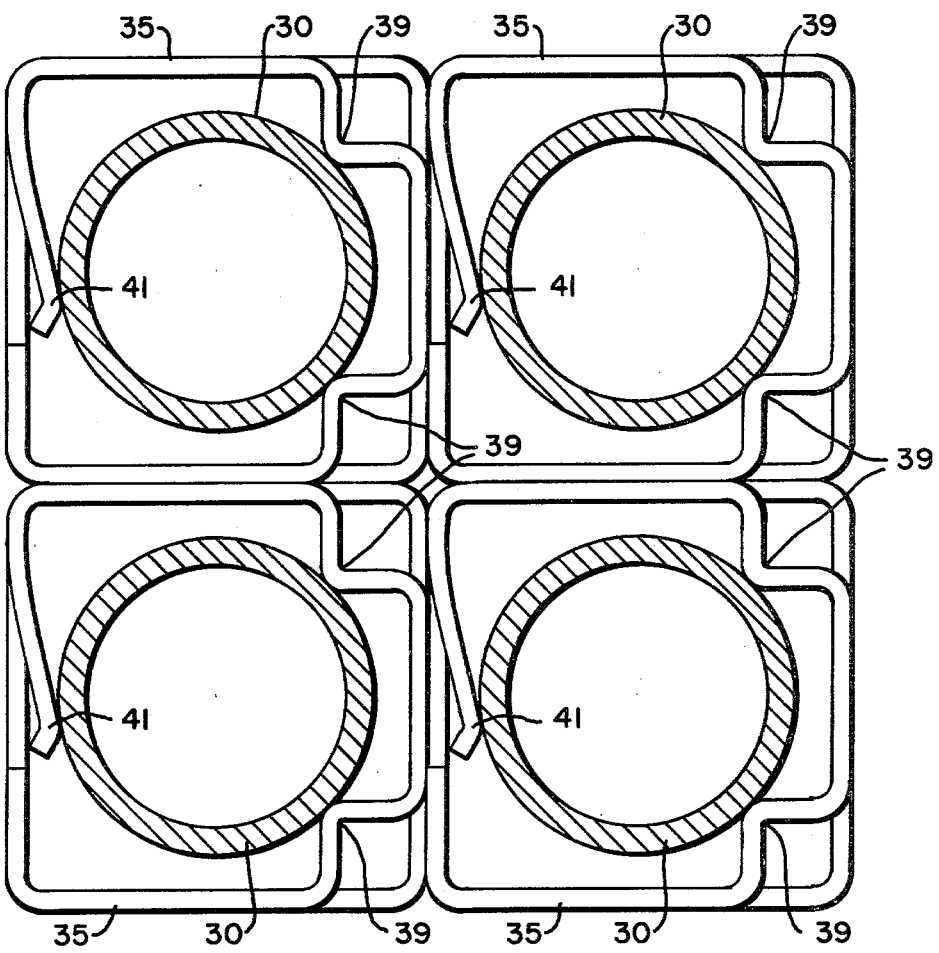
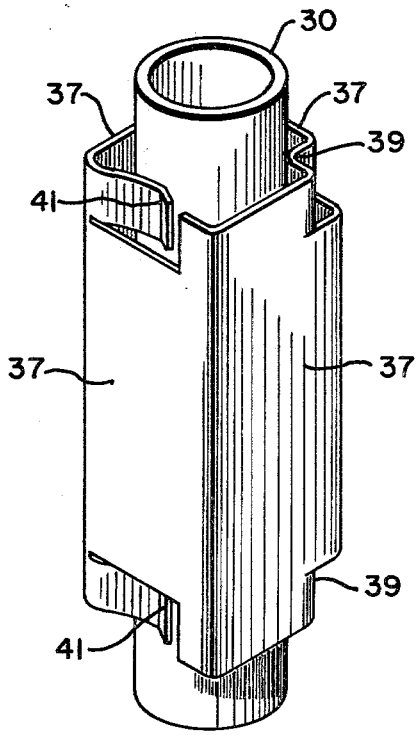
Fig. 4

Fig. 5
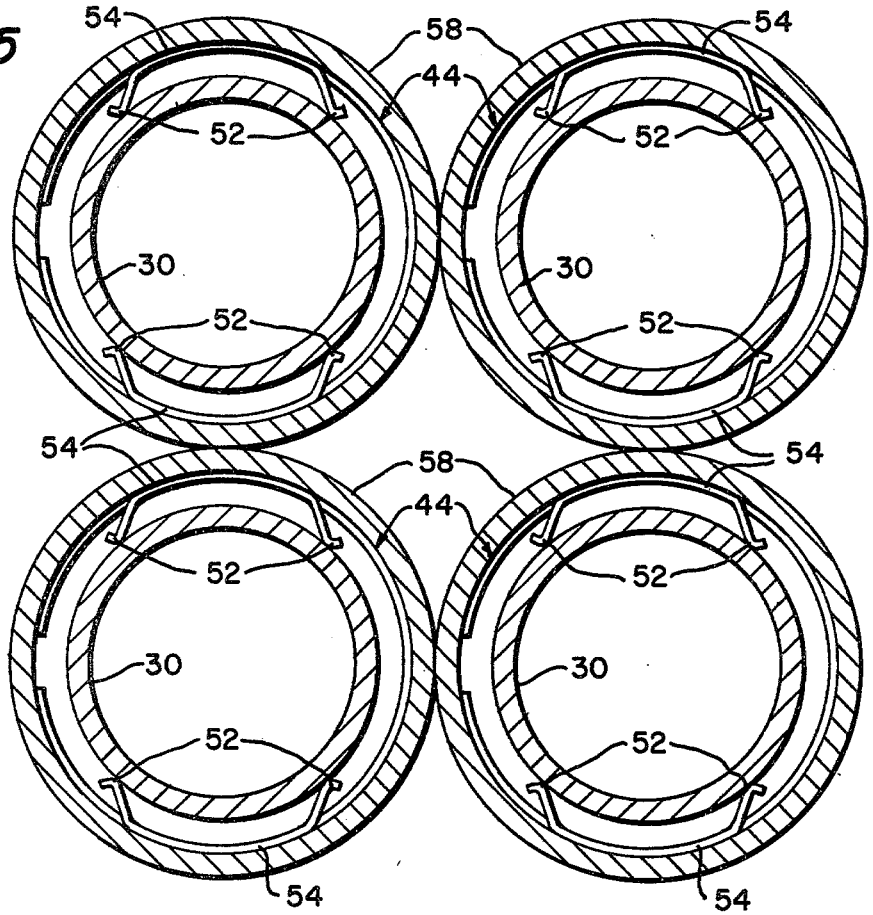
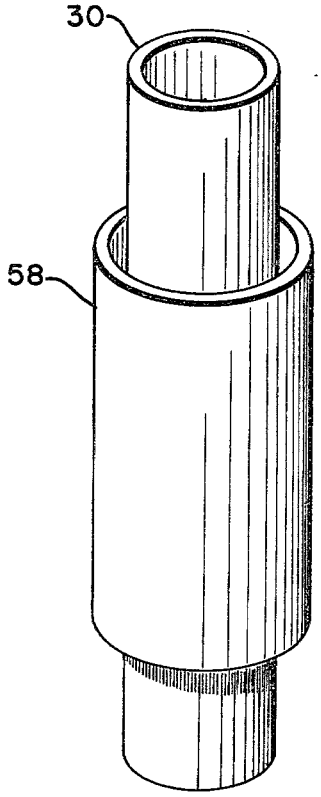
Fig. 6B
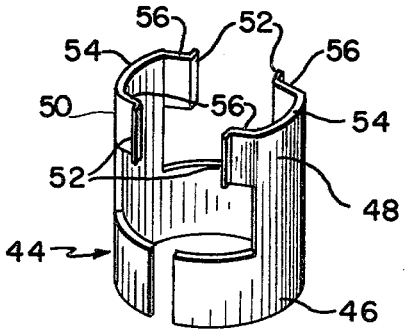
Fig. 6A

Fig. 7
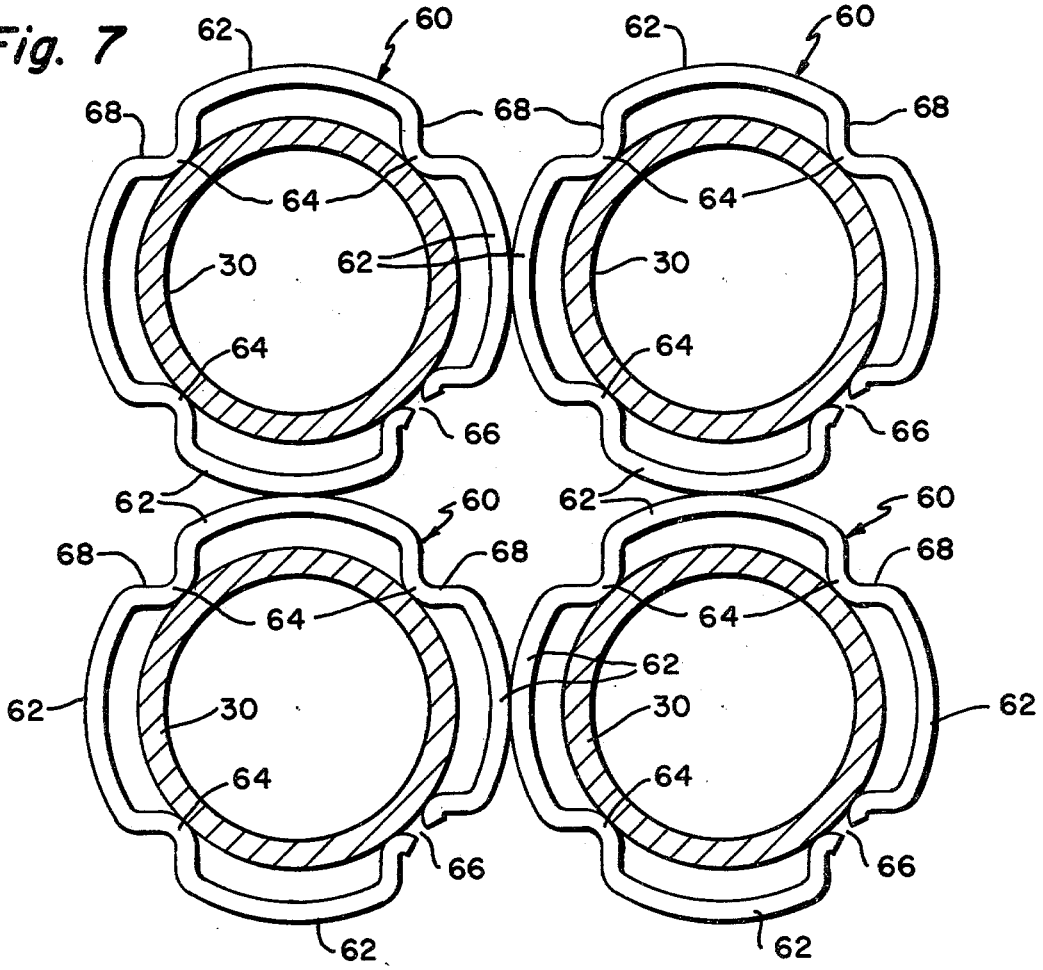
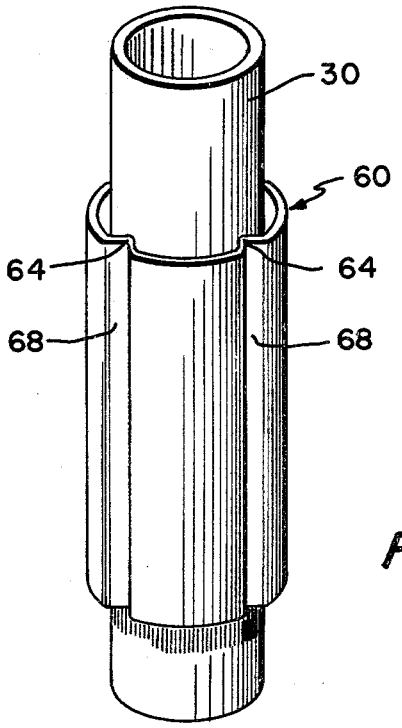
Fig. 8

STEAM GENERATOR TUBE SUPPORT SYSTEM

BACKGROUND OF THE INVENTION

As is known, nuclear power plants of the pressurized-water type include steam generators in which the steam which drives the turbine-generator is produced from a secondary coolant by transfer of heat in a heat exchanger from a closed primary coolant system. A steam generator of this type consists of a bundle of vertically-oriented tubes inside a cylindrical shell. In certain steam generators, the tubes are inverted U-tubes fastened to a lower tube sheet. In other types of steam generators, the tubes are straight and are fastened to lower and upper tube sheets. In either case, the primary coolant from the reactor flows inside the vertically-oriented tubes and steam is generated in the secondary coolant outside the tubes and flows upwardly along the tubes within the cylindrical shell of the steam generator.

The tube bundle is ordinarily many feet high; and, consequently, the tubes must be supported laterally at several elevations along their length in order to limit flow-induced vibrations during normal operation and to limit stresses in the tubes during severe abnormal conditions such as earthquakes or tube ruptures.

The lateral support means for tubes in existing steam generator designs consists of a plurality of spaced tube support plates or egg-crate support grids. In the case of tube support plates, drilled or broached holes are provided through which the tubes pass with small diametral clearances. In order to limit fretting at the supports during operation, the radial clearances between the tubes and the lateral support device must be small and the tube support plates or grids are made of a different material than the tubes. Materials commonly used for lateral supports are carbon steel and ferritic stainless steel. The tubes are commonly a high nickel alloy.

Carbon steel has been found to be susceptible to corrosion in the secondary-side water chemistries of power plants. A result has been the phenomenon of "tube denting", in which build-up of the corrosion product (which has larger volume than the base metal) squeezes the tube at the support location and creates tensile stresses in the tube support plate or grid. Ferritic stainless steel is viewed as a means of overcoming tube denting but, based on limited experimental evidence to date, it is also apparently susceptible to corrosion in typical secondary-side water chemistries.

Tube support plates or grids are expensive to construct and, in part because of the small clearances at the supports, cause installation of tubes to be somewhat difficult, and consequently expensive.

SUMMARY OF THE INVENTION

In accordance with the present invention, corrosion of the tube support plate or grid, the consequent effects of corrosion (e.g., denting), and fretting between the tubes of a heat exchanger and the tube lateral support plates are essentially eliminated by replacing the support plates or grids with spring collar devices which surround each tube such that adjacent spring collars are in abutment with each other to form a cluster of tubes, each surrounded by a spring collar device. The cluster of tubes is held together by the compressive effect of an encircling band or some other device at the periphery of the cluster which abuts against the spring collars on the outer rows of tubes of the tube cluster.

Because of the length of the tube bundle, a number of spring collar devices are spaced along the length of each tube to provide groups of spring collar devices whose midpoints lie in successive planes spaced along the tubes with the collar devices in the respective planar areas being in abutment with each other. With this arrangement, no relative movement occurs between the spring collar devices and the tubes themselves; however there can be relative movement between abutting spring collar devices. Since there is no movement between the tubes and their supporting spring collar devices, the potential for fretting is essentially eliminated.

As will be apparent from the subsequent description, the material of the spring collar can be a high nickel alloy which is less susceptible to corrosion than the materials used in tube support plates or grids. Further, the configuration of the spring collar is such as to reduce the potential for locally high temperatures on the tube wall and resultant local deposition of corrosion inducing impurities from the secondary coolant.

The above and other objects and features of the invention will become apparent from the following detailed description taken in connection with the accompanying drawings which form a part of this specification, and in which:

FIG. 3 is an enlarged cross-sectional view showing on type of spring collar device which may be utilized in accordance with the invention;

FIG. 4 is a perspective view of the spring collar device of FIG. 3;

FIG. 5 is a cross-sectional view of another embodiment of the invention utilizing a modified spring collar device;

FIG. 6A is a perspective view of the spring clip employed in the embodiment of the invention shown in FIG. 5;

FIG. 6B illustrates the completed spring collar device of FIG. 5 surrounding a tube and utilizing the spring clip of FIG. 6A;

FIG. 7 is a cross-sectional view of still another embodiment of the invention utilizing a modified spring collar device; and FIG. 8 is a perspective view of the spring collar device of FIG. 7.

Figure 1:
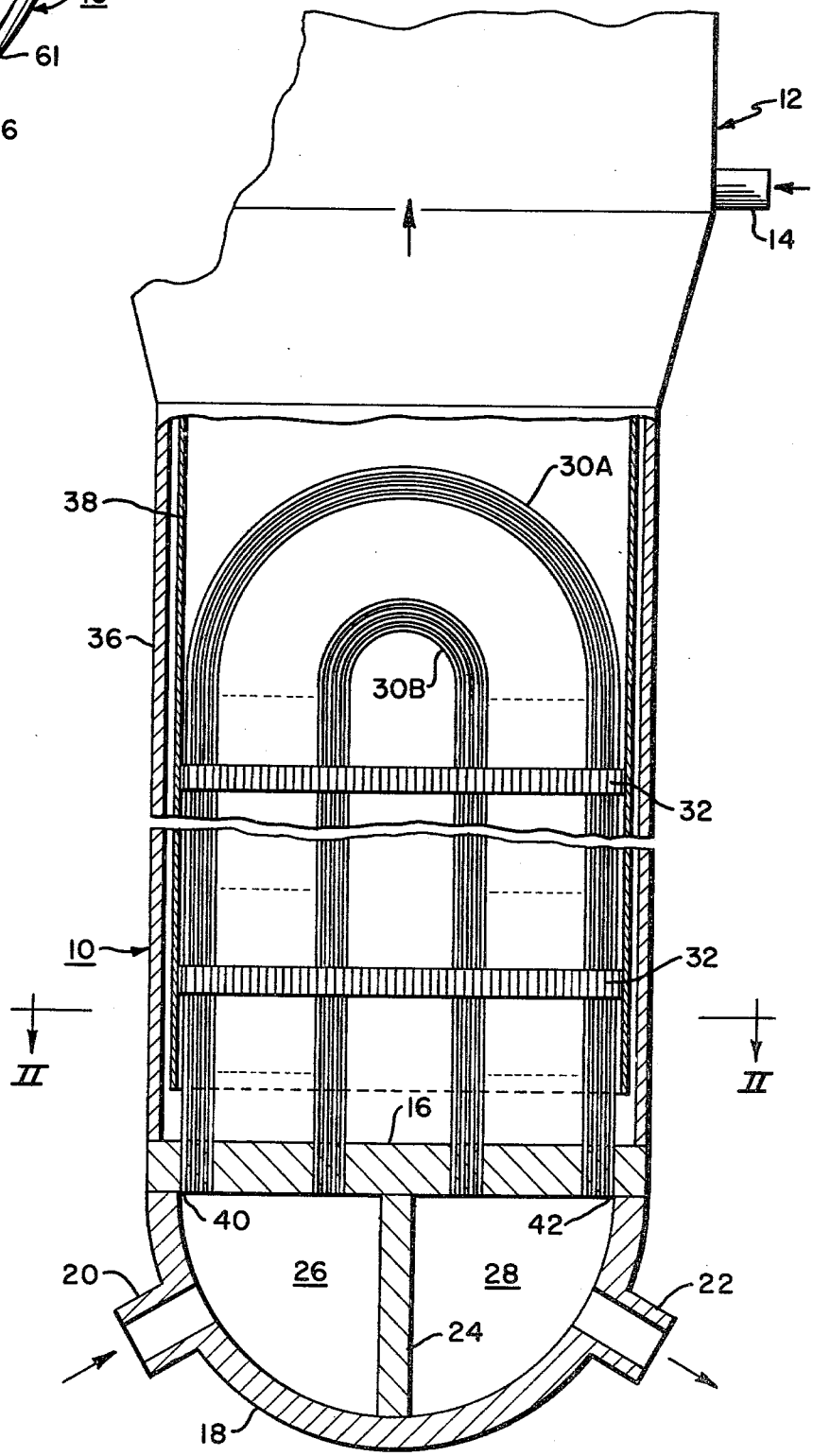
FIG. 1 is a cross-sectional view of a typical steam generator with which the tube support system of the invention may be used.

With reference now to the drawings, and particularly to FIG. 1, a schematic cross section of a typical U-tube steam generator for a nuclear power plant is shown. It comprises a lower shell 10 and an upper shell 12. The upper shell 12 normally contains steam separators and steam driers which form no part of the present invention and, consequently, are not shown herein. Feed water from a condenser for a steam turbine, for example, enters the upper shell 12 through a conduit 14 where it flows downwardly onto a relatively thick tube sheet 16, typically formed from carbon steel. Beneath the tube sheet is a semicircular channel head 18 having a primary coolant inlet 20 and a primary coolant outlet 22 which are separated by a partition 24 so as to provide two compartments 26 and 28 in the channel head 18.

Contained within the lower shell 10 is a tube bundle comprising a plurality of U-shaped tubes, only the extreme inner and outer tubes of which are shown in FIG. 1 and identified by the reference numerals 30A and 30B.

While only a few tubes are shown in FIG. 1, those skilled in the art will appreciate that the entire volume within lower shell 10 is filled with U-shaped tubes each having an end communicating with the chamber 26 and another end communicating with the chamber 28 so that the entire area of the tube sheet 16 has tubes passing therethrough.

Figure 2:
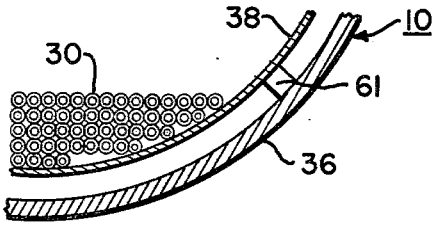
FIG. 2 is a partial cross-sectional view taken substantially along line II—II of FIG. 1.

FIG. 2 is a partial cross-sectional view of a completed tube bundle and includes a plurality of tubes, indicated generally by the reference numeral 30, which fill the entire cross section of the lower shell 10. The tubes may be arranged on a square or triangular pitch. The illustration in FIG. 2 shows a square pitch arrangement. In FIG. 2, the numeral 36 indicates the outer wall of the lower shell 10 and the numeral 38 designates a steel or the like baffle which surrounds the tube bundle to separate the downward flow of subcooled water from the upward flow of steam and to hold the tubes 30 in assembled relationship.

Reverting again to FIG. 1, primary coolant from the reactor will enter chamber 26, enter the lower ends 40 of the tubes 30 and then pass out of the other ends 42 of the same tubes 30 and into chamber 28 which communicates with outlet port 22 leading back to the nuclear reactor, now shown. Water entering the feed water nozzle 14 will flow downwardly onto the tube sheet 16 and become heated by the medium flowing through the tubes 30, thereby forming steam which rises upwardly and into the upper shell 12.

The present invention relates to a system for giving lateral support to a bundle of tubes, such as tubes 30, which are dispersed throughout the entire cross section of the lower shell 10. As was explained above, it has been common in the past to laterally support the tubes 30 by passing them through openings or holes in the tube support plates located at the approximate positions of the lateral supports 32 shown in FIG. 1. This, however, leads to the problems of fretting at the peripheries of the holes in the support plates during operation or of galling during tube insertion. It also results in local high temperatures of the tube wall where the tube and tube support plate are separated only by a small clearance, concentration of impurities in the water and consequent corrosion of the tube support plates which leads to a build-up of corrosion products and "tube denting" as explained above, or simply weakening of the tube support plate by loss of metal.

In accordance with the present invention, fretting and corrosion build-up are prevented by surrounding each of the tubes, at spaced locations in the lower shell 10, with spring collar devices, one embodiment of which is illustrated in FIGS. 3 and 4. As shown in FIG. 3, each of the tubes 30 is surrounded at spaced points along its length by spring clips or collars 35, the details of which are shown in FIG. 4. Each spring clip 35 comprises a stamping of generally square cross section having four side walls 37 which abut the walls of adjacent spring clips. At the upper and lower ends of one of the walls 37 are inwardly-bent portions 39 forming steady rests which abut the periphery of an associated tube wall. At the top and bottom of the diametrically-opposite wall 37 are inwardly-bent portions 41 which form leaf springs which bear upon the opposite side of each tube. As will be understood, any lateral movement of the tubes 30 will cause a deflection of the leaf springs 41 which will nevertheless remain in engagement with, and bear upon, the tube wall. Because of the degree of flexibility afforded by the springs 41, tube fretting and corrosion build-up will be eliminated or materially reduced. At the same time, the spring clips readily permit the upward flow of steam past the tube walls.

The clips 35 are passed over the tubes 30 and are positioned at spaced locations with the clips for all tubes at each location or cluster having their midpoints lying in a common plane. Each cluster, in turn, is encircled by a band, such as baffle 38 shown in FIGS. 1 and 2, spaced from the wall 36 of the steam generator by spacers 61.

Another embodiment of the invention is shown in FIGS. 5, 6A and 6B. In this case, each spring clip 44 is provided with a split annular lower portion 46 and upstanding arcuate portions 48 and 50 which are separated one from the other. The upper parts of the arcuate portions 48 and 50 are bent inwardly to provide spring tabs 52 which, as shown in FIG. 5, abut the outside wall of each tube 30 on opposite sides thereof. In this regard, it will be appreciated that the spring clip 44 comprises a tube-encircling stamping having portions (i.e., the ends of tabs 52) which abut an associated tube wall and portions 54 which are spaced from the wall of the tube, the two portions 52 and 54 being interconnected by bent portions 56. Surrounding the spring clip 44, as best shown in FIGS. 5 and 6B, is a tubular collar 58 which abuts similar collars of adjacent tubes 30.

In assembling the tube bundle, spring clips 44 and their encircling collars 58 are passed over the tubes 30 at spaced locations as in the previous embodiment, with the spaced spring clips along the length of the tubes all having their midpoints lying in common planes whereby a band, such band 38 shown in FIGS. 1 and 2, can encircle all of the tubes and press the tubular collars 58 of adjacent tubes into engagement with each other. The tubes 30 are thus permitted a degree of lateral movement against the force of the spring tabs 52 within each collar 58. At the same time, because of the flexibility involved, there is little or no relative motion between each tube 30 and its lateral support. Consequently, no potential for fretting of the tube exists. That is, all relative motion is between the spring collar devices. There is also less restriction to secondary coolant flow parallel to the tubes than is the case with the prior art tube support plates or grids described above. As a result, tube wall superheat, which is a cause of localized deposition of suspended or dissolved solids, and coolant pressure drop, are both reduced. The preferred material of the spring clips is INCONEL (Trademark). As was explained above, the baffle 38 or other compression device encircles the tube bundle as shown in FIGS. 1 and 2. Several different configurations of compression devices are possible such as a flexible band, a split ring, wedges and the like. Lateral forces on the tubes are transmitted through the baffle 38 or other compression device to the wall 36 (FIG. 2) of the steam generator through the spacers 61.

With reference now to FIGS. 7 and 8, still another embodiment of the invention is shown which, like the embodiment of FIGS. 3 and 4, does not employ a surrounding tubular sleeve, such as collar 58 in FIG. 6B. In FIGS. 7 and 8, spring collars 60 surround each of the tubes 30 and comprise radially-outwardly extending arcuate lobes 62 interconnected by radially-inwardly extending portions 64 which abut the wall of each tube 30. The radii of the lobes 62 have centers coincident with the central axis of each tube 30 such that line contact will be made between a lobe 62 and a lobe of an adjacent tube regardless of the angular relationship of the tubes 30. In FIG. 7, the tubes 30 are shown in exact quadrature; however it will be appreciated that in an actual installation, and particularly since the bundle of tubes will have a circular outer periphery, the tubes may not be in exact quadrature throughout the cross section of the steam generator. Note also that each of the spring collars 60 is split as at 66 between adjacent lobes so as to achieve greater flexibility of each of the spring collars 60. As in the previous embodiments, the spring collars 60 permit relative movement between the tubes 30 without fretting and corrosion build-up. Also, as in the previous embodiments, each spring collar device includes a tube-encircling stamping having portions 64 which abut an associated tube wall, portions 62 which are spaced from the tube wall and bent portions 68 interconnecting the abutting and spaced portions 64 and 62.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A system for supporting a bundle of tubes against lateral movement in a heat exchanger in which a first fluid flows through the tubes and a second fluid flows past the outer walls of the tubes so as to transfer heat from one fluid to the other, said system comprising spring collar devices each surrounding a tube forming said bundle with adjacent spring collar devices being in engagement with each other to form a cluster of such spring collar devices to laterally support the bundle of tubes, each spring collar device having at least one resilient tube contacting portion for independent resilient lateral support of a tube, the resilient tube contacting portion of each spring collar device comprising a spring tab, tube plate means to support the ends of the tubes for said first fluid flow through the tubes, and a band encircling the outer peripheral surface of said cluster to compressively hold said collar devices together at a spaced relation from said tube plate means while the spring collar devices permit a limited degree of lateral movement of each tube against its encircling spring collar device.

2. The system of claim 1 wherein there are a number of spring collar devices spaced along the length of each tube, the spring collar devices being spaced along the respective tubes to provide groups of spring collar devices whose midpoints lie in successive planes spaced along the tubes with the collar devices in the respective planar areas being in abutment with each other.

3. The system of claim 2 wherein said spring collar devices are shaped to permit a fluid to pass therethrough along the lengths of the tubes.

4. The system of claim 1 wherein each of said spring collar devices includes a tube-encircling stamping having portions which abut an associated tube wall and portions which are spaced from the tube wall, together with bent portions which interconnect the abutting and spaced portions to afford radial flexibility to the collar device.

5. The system of claim 4 wherein each of said spring collar devices is split about its periphery.

6. The system of claim 4 wherein said bent portions extend throughout the length of each spring collar device, the bent portions being interconnected by arcuate lobes.

7. The system of claim 4 wherein said bent portions comprise radially-inwardly bent tabs having inner ends which abut the wall of an associated tube.

8. The system of claim 1 wherein said spring collar devices each includes an inner spring member having portions in abutment with the wall of a tube defining said resilient tube contacting portion and a tubular collar surrounding and in abutment with the outer periphery of said inner spring member.

9. The system of claim 8 wherein said tubular collars of adjacent tubes in said bundle abut each other.

10. The system of claim 1 wherein each spring collar device is generally rectangular in cross section and has four essentially flat walls which abut the walls of spring collar devices of adjacent tubes in said bundle.

11. The system of claim 10 wherein inwardly-bent portions are provided at the top and bottom of one wall of the spring collar device forming steady rests which abut the periphery of an associated tube wall, the wall of said collar opposite said one wall having inwardly-bent portions at the top and bottom thereof, said bent portions forming leaf springs which bear upon the periphery of said associated tube opposite said one wall.

* * * * *